United States Patent [19]

Shaw

[11] Patent Number: 4,760,588

[45] Date of Patent: Jul. 26, 1988

[54] CONTROL SYSTEM FOR STARTER FOR X-RAY TUBES

[75] Inventor: Robert H. Shaw, Addison, Ill.

[73] Assignee: Advanced Instrument Development, Inc., Melrose Park, Ill.

[21] Appl. No.: 608,131

[22] Filed: May 8, 1984

[51] Int. Cl.[4] ..... H05G 1/66

[52] U.S. Cl. ..... 378/93; 378/94

[58] Field of Search ..... 378/93, 94

[56] References Cited

U.S. PATENT DOCUMENTS 3,641,408 2/1972 Fiocca ..... 378/93

3,787,724 1/1974 Pedersen et al. ..... 318/410

3,832,553 8/1974 Seifert ..... 378/93

*Primary Examiner*—Craig E. Church

*Attorney, Agent, or Firm*—Leo J. Aubel; Stephen R. Arnold

[57] ABSTRACT

A boost circuit for providing rapid acceleration of anode rotating motors for X-Ray tubes features provision for supplying to the motor for a limited period of time a relatively high power AC excitation at a frequency well above that corresponding to the rotation speed to be maintained during exposure. Once proper operating speed is reached, the motor power supply voltage is reduced to a safe power level with respect to the stator windings, and the frequency is reduced to correspond to the desired running speed during exposure. In the preferred embodiment the changeover is governed by means of an empirically adjusted timer; however, changeover may be controlled by a variety of means.

5 Claims, 2 Drawing Sheets

28
24
30
18
20
34
CA
36
35
44
D3
T7
40
42
T8
D4
R7
R8
+24
L14
L10
L7
C3
L8
D1
I6
D2
T5
T6
I2
I4
+24
T1
T2
T3
T4
L3
R5
R6
G4
G8
G2
G3
G6
G7
+12
S1A
L5
L2
G1
G5
R3
C1
C2
R4
-12
-24
L1
A
I1
L4
C8
R1
L0
R2
10
T9
T10
T11
T12
R11
R12
D
I2
Q5
48
+12
Q4
Q2
Q3
S1B
+12
46
C5
R19
R10
X
Q1
I2
C6

CONTROL SYSTEM FOR STARTER FOR X-RAY TUBES

TECHNICAL FIELD OF THE INVENTION

The X-Ray control and generation art, in particular motor drive systems for X-Ray tube target anodes.

BACKGROUND OF THE INVENTION

The present invention is related to U.S. Pat. No. Re. 28,618 entitled "SOLID-STATE POWER SUPPLY SYSTEM FOR ROTATING ANODE X-RAY TUBES", and to U.S. Pat. No. 3,968,413 entitled "VARIABLE SPEED STARTER FOR X-RAY TUBES", both patents being assigned to the same assignee as the present invention. The disclosures therein are specifically incorporated herein by reference.

As will be appreciated, the present invention utilizes concepts, and circuitry similar to those disclosed in said patents. Importantly, the present invention improves on aspects of the circuitry disclosed in said patents, and more particularly provides a control subsystem for improving the acceleration characteristics of the anode rotation, as will be explained hereinbelow.

X-ray tubes having rotatable anodes are well known. In such tubes, the anode is caused to rotate to present a continually changing target area so that heat generated by the electron bombardment may be more easily dissipated. This heat dissipation enables higher energy levels to be used, resulting in increased X-ray output as compared with tubes having fixed anodes. The rotating anodes of X-ray tubes are generally driven by split phase motors, and in fact may be integral with the rotors of said motors. These motors have been heretofore operated from power sources capable of providing 180 Hz. A.C. power first at a relatively high voltage for rapid acceleration of the anode to proper speed, and thereafter at a reduced voltage during exposure.

There are several reasons why rapid acceleration up to operating speed is consisdered essential, and they are related in one way or another to the useful life of the X-Ray tube. It is generally accepted that such anodes must rotate above 9,000 r.p.m. to achieve adequate heat spreading. On the other hand, since the entire rotating system must be rotatably supported within a static vacuum, truly adequate bearing lubrication which will not outgas and cause flashover destruction of the tube is a problem which has never been adequately solved. As a result, prolonged operation at high rotational speeds in the above-mentioned range can be expected to result in bearing failure, at which point the tube must be replaced.

This is admittedly an expensive operation, and a substantial prolongation of useful tube life can be expected in these high rotational speeds can be achieved at very short time. Since in many cases the actual exposure time once the anode is up to proper speed can be comparable with the exposure time itself, any system which materially reduces the acceleration or windup time is desirable. A further advantage of rapid acceleration time arises from the existence of certain well-known resonances in armature-anode systems, these resonances typically being encountered in the 6,000–7,000 r.p.m. range. Such resonances can cause additional wear, and the time of passage through these critical ranges must similarly therefore be minimized.

Moreover, the exact timing of the instant of exposure may be critical with respect to optimum delineation of transient phenomenona in medical diagnosis, as for example, the passage of radio-opaque dyes in the bloodstream or barium salts in the large intestine. Here again, a substantial reduction in wind-up time to operating speed would be a useful feature.

A conventional approach, as exemplified in the various prior art systems, including the abovementioned U.S. Pat. No. Re. 28,618, achieves initial rapid acceleration by supplying the 180 Hz. power at an elevated voltage until the motor has come up close to synchronous speed, after which time the voltage is reduced to that necessary to maintain the necessary speed in "run" mode, i.e., during exposure. There is a limit, however, beyond which the supply voltage cannot be raised during the acceleration phase, and this is set by the saturation properties of the motor. As the motor input voltage is raised beyond the point where saturation sets in, very little additional torque is developed; however, a marked increase in stator winding current occurs, with concomitant possible overheating of the stator windings. Since the stator windings are normally provided with a combination of high voltage insulation and cooling by means of an oil bath around them, even a temporary heating above critical levels can cause gas bubble formation in the oil, with the possibility of attendant high voltage strikeover causing catastrophic failure of system and possible danger to attendant personnel. Thus, although prior art systems do provide for a measure of rapid motor windup capability, the acceleration times achieved remain unacceptably long.

Therefore, it would be a useful feature to be able to shorten the acceleration time of the motor significantly.

SUMMARY OF THE INVENTION

An apparatus and method are disclosed for controllably accelerating or "boosting" the rotation of the anode of an X-ray tube from a stopped condition to a selected rotating speed within a minimum time. More specifically, power to the stator of an X-Ray tube motor is applied at a first higher frequency during an initial boost cycle. When the rotor has reached a selected running r.p.m. the frequency is decreased and the voltage supplied to the stator is decreased, whereupon the rotor continues to operate at its running speed until subsequently braked. The foregoing results in an acceleration characertistic or curve which is steeper or faster due to the fact that more power can be supplied to the stator at the higher frequency without saturating the stator, and also because the acceleration curve is linear to a higher frequency; that is, the acceleration curve levels off later in time to thereby provide a more effective boost cycle. In the preferred embodiment the boost cycle operates at 225 Hz. and the run cycle operates at 180 Hz., which reduces the length of the boost cycle from 4.5 (four and one-half) seconds to 3 (three) seconds; that is, it takes the rotor or anode only 66% as long to attain its running speed. The frequency is reduced to the lower value to provide for an acceptable rotation speed of the order of 10,000 r.p.m. during exposure. If the higher frequency were maintained, then unacceptably high rotation speeds of the order of 13,000 r.p.m: would result. Rather than prolonging bearing life, such operation would severely shorten it.

It should be understood at the outset that the invention is that the indicated frequencies are examplary, and the inventive system is not to be limited to any specifically enumerated frequencies or supply voltages. The foregoing features and advantages of the present invention will be apparent from the following more particular description of the invention. The accompany drawings herein are useful in explaining the invention wherein:

DESCRIPTION OF THE INVENTION

Figure 1:
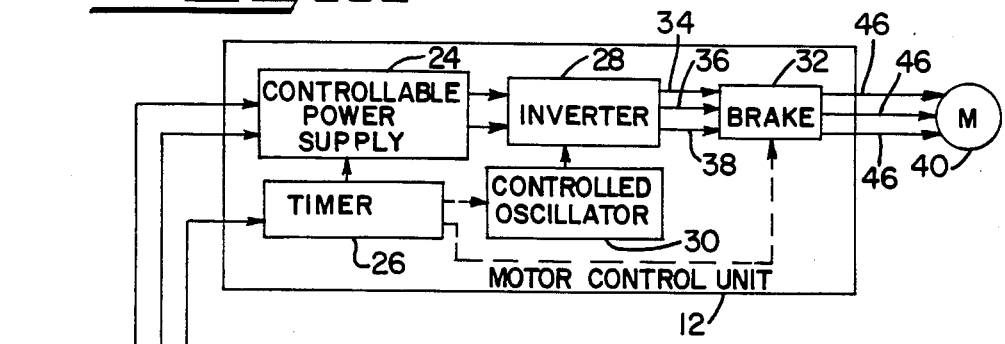
FIG. 1 is a functional block diagram of the principal elements of a motor control unit used to control the speed of the drive motor of a rotating anode X-Ray tube, the motor control unit being interconnected to a central control unit which supplies the remaining control and power functions to the tube.
Figure 1:
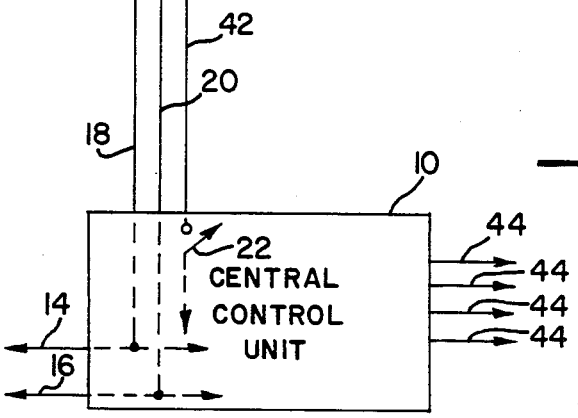

Refer now to FIG. 1, showing in block schematic form the two principal elements of a rotating anode X-Ray system. A central control unit 10 supplied with electrical power from the power mains over lines 14 and 16 provides to output lines 44—44 the various power and control signals necessary to power an X-Ray tube during exposure. The central control unit 10 can take a variety of forms well known in the art, and need not be discussed in detail for purpose of the present disclosure. Suffice it to say, this unit contains the various controls, e.g., exposure time, high voltage setting, beam setting, etc. which the operator adjusts for the purposes of controlling the exposure. As is well known in the art, because of the high beam energies involved, the anode of the X-Ray tube is prone to severe cratering arising from the electron impact and local heating. As a result of this, a standard practice is to provide a motor-driven rotatable anode integral with the X-Ray tube structure so that the electron beam does not dwell for a substantial period of time upon a given anode region, thereby spreading the heat dissipation around the structure, and substantially supressing the aforementioned cratering action.

It appears to be well established in the industry that an operating speed of approximately 9,000 r.p.m. is optimum for the "run" speed of the motor during exposure. The function of the motor control unit 12 in FIG. 1 is to accelerate the anode motor to an optimum "run" speed in the neighborhood of 10,000 r.p.m. in minimum possible time. The shorter this acceleration time can be held, the shorter is the passage through the dangerous resonances in the 6,000–7,000 r.p.m. range, and the total high speed running time of the motor is correspondingly minimized. To accomplish this, the motor control unit 12 provides for a high initial power delivery to the motor 40 over motor lines 46—46 during a prescribed acceleration interval set by a timer 26, responsively to a start signal provided by the central control unit. This provision is here schematically indicated by closure of a switch 22.

Closure of switch 22 actuates a timer 26 via a control line 42. The function of this timer is to control a controllable power supply 24 fed via power lines 18 and 20 connected to the main power lines 14 and 16 to produce a high DC voltage output supplied to an inverter 28 for a prescribed period of time, i.e., during the acceleration phase, and thereafter to control the power supply to provide a reduced voltage to this inverter 28 during the "run" phase once the motor is up to the proper speed for exposure. The frequency of the output power supplied to the motor via lines 34, 36, 38 from inverter 28 is governed by a controlled oscillator 30, this oscillator in turn having its frequency controlled by the timer 26 so that during the initial acceleration phase the oscillator 30 is caused to run at 225 Hz., and during the run phase at 180 Hz.

Thus, during acceleration the high voltage 225 Hz. condition is applied to the motor 40, and when the motor has reached a proper operating speed above 9,000 r.p.m. the timer causes the motor drive voltage and frequency both to be reduced. The time at which the timer makes the transition in its control function is set largely by the known properties of the motor, and is most simply achieved by empirical adjustment. Alternatively, suitable sensings could be derived from the motor itself and fed to the motor control unit 12 by a suitable feedback arrangement.

A brake circuit 32 is normally interposed between the inverter 28 and the motor 40, this circuit serving to decelerate the motor rapidly upon termination of the exposure cycle. This may be achieved by a variety of methods which are of no concern here; however, one well-known method is to short the main line 34 together with the phase line 36, and to apply a consistant potential between this pair and the common line 38. During this phase the inverter lines 34–38 are disconnected by suitable switching means.

In the preferred form of the invention to be described herein, the motor 40 is powered during the acceleration phase by 225 Hz. square wave of the order of 700 volts r.m.s., and during the run phase by a 100–150 volt r.m.s. square wave at 180 Hz. It will be noted that this latter value corresponds to a synchronous rotation rate of 10,800 r.p.m. as indicated by the dashed horizontal line in FIG. 4.

Figure 4:
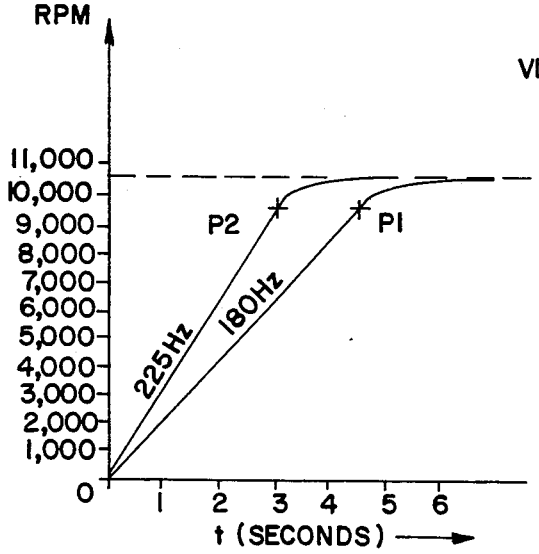
FIG. 4 is a graph useful in explaining the operation of the invention.

Further with respect to FIG. 4, there are shown two experimentally determined points P1 and P2, one corresponding to the normal windup time of a conventional system using 180 Hz. continuous power application and requiring 4.5 seconds to accelerate to a speed of 9,600 r.p.m., followed thereafter by the usual asymptotic approach to the synchronous speed of 10,800 r.p.m. The "180 Hz." line there shown represents the situation where maximum power has been applied to the motor as limited by saturation effects, power having been reduced to a suitable value after 4.5 seconds to prevent the aforementioned overheating. The second curve, labeled "225 Hz." shows the acceleration of the present system using both voltage and frequency shifting. It will be noted that a substantial reduction in windup time has been achieved.

With the exception of the experimental points P1 and P2 and the synchronous indicated speed, these curves are only approximate with respect to initial accelerations; asymptotic behavior typically begins to set in earlier than indicated.

Figure 2:
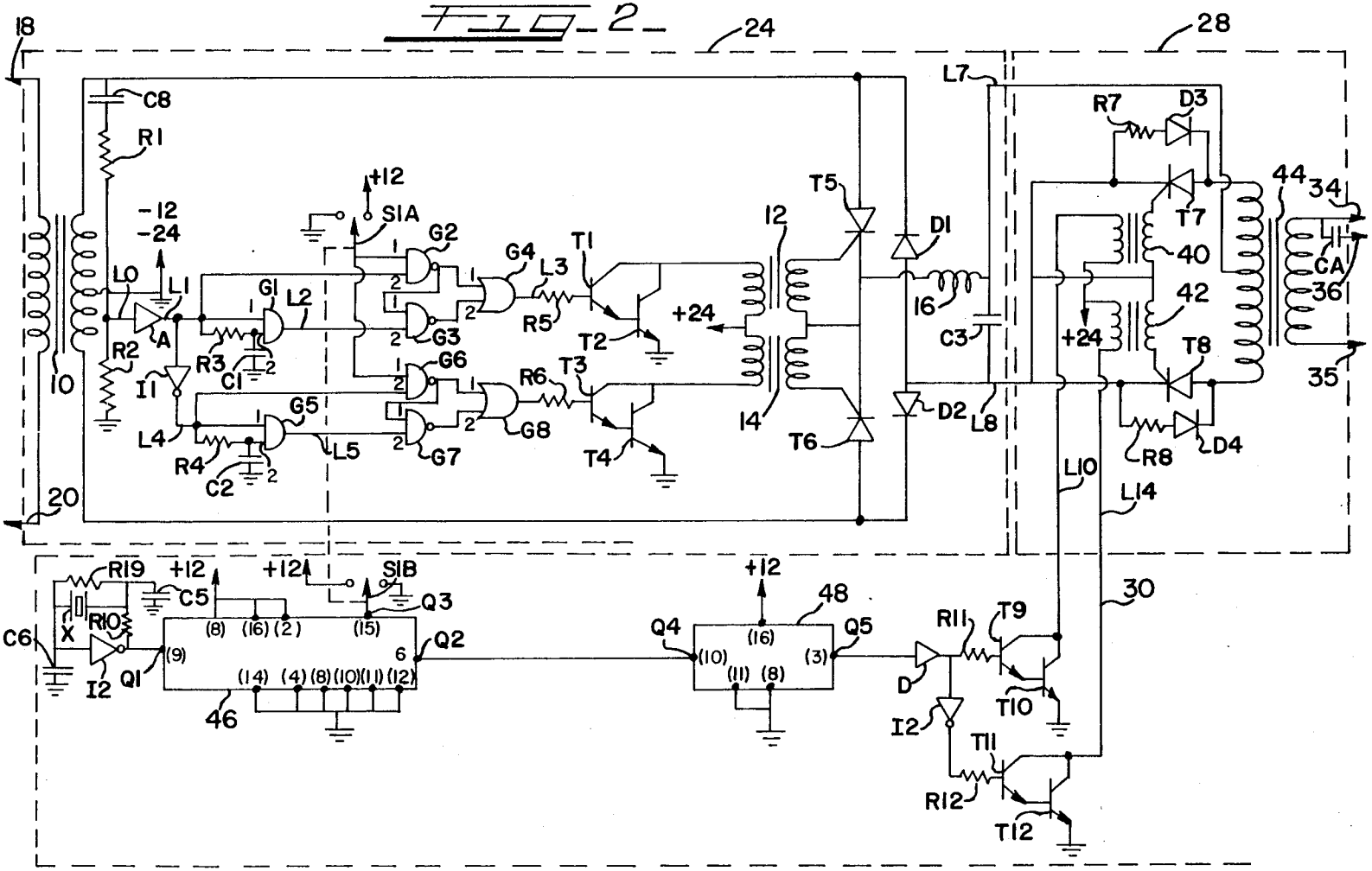
FIG. 2 is a circuit schematic diagram of the three principal elements of the motor control unit of FIG. 1, namely, a controlled oscillator, a controlled power supply, and an inverter.

Turning now to the principal details of the system, namely the controllable power supply 24, the inverter 28, and the controlled oscillator 30, reference is now made to FIG. 2, wherein these three subsystems are denoted by dotted boundaries. Considering first the controllable power supply 24, the objective here is to provide initially on output lines L7 and L8 thereof during an initial predetermined period a voltage of approximately 160 volts, and thereafter during the run phase a reduced voltage of 40 volts. This is most expeditiously provided by a logic-controlled phase shift recitifer system configured as a full wave bridge circuit consisting of SCR of two silicon controlled rectifiers (SCR's) T5 and T6 in conjunction with diodes D1 and D2. System from the power mains is provided via lines 18 and 20 through a transformer 10 to provide power to this full wave rectifier, the output being supplied to output lines L7 and L8 through a simple inductor input filter consisting of inductor 16 and capacitor C3. The voltage developed across capacitor C3 will be governed by the firing angles of the SCR's T5 and T6. The firing angle of the SCR's is governed by switch S1A, here shown functionally as a simple single-pole double-throw switch. As previously discussed, the choice of switching means whereby the power supply is caused to be is actuated between low voltage and high voltage conditions is immaterial, and may be achieved either by a timer as shown, or by feedback systems as previously mentioned. Switch S1A is therefore to be regarded as the functional equivalent of whatever control system or logic is used to control the two states of the controllable power supply 24. As will be shortly seen, switch S1A could readily take the form of a logic gate.

With respect to achieving the control of the phase-shift rectifier section, triggering pulses are supplied at appropriate times during the power line waveform via transformers 12 and 14 so as to set the conduction angle of the two SCR's T5 and T6 either through a complete half cycle each, or alternatively only during a terminal portion thereof. To achieve this control, a logical gating system is provided, and will now be discussed.

Figure 3:
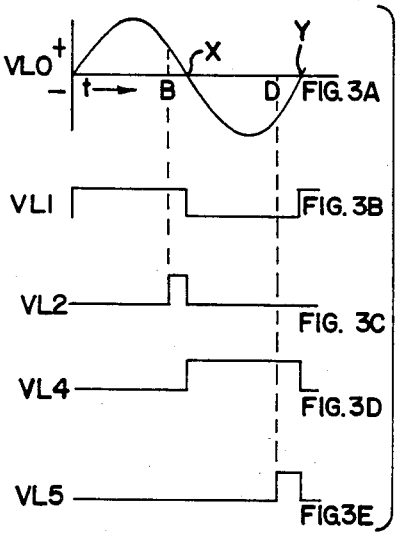
FIGS. 3A–3E are timing diagrams showing selected waveforms at various points in the circuit of FIG. 2.

A portion of the output voltage of transformer 10 is provided to an amplitude comparator A via capacitor C8 and an attenuator consisting of resistors R1 and R2. Capacitor C8 is chosen sufficiently large that negligible phase shift occurs in this network. The resulting waveform is fed to the input of comparator A via line L0. The voltage on line L0 (VL0) is shown in FIG. 3A. Here the end of the second and fourth quadrants of the power line waveform are indicated as poists X and Y respectively. Points B and D represent desired triggering points for the SCR's T5 and T6 to be controllably selected by switch S1A to provide the low power output condition of the controllable power supply 24. The output of the amplitude comparator A is fed via line L1 to the input terminal 1 of AND gate G1, and through a delay network R3-Cl to terminal 2 thereof. As a result, the square waveform VL1 on line L1 (FIG. 3B) is converted to a train of short pulses at the output of gate G1 on line L2 to produce the wave train shown in FIG. 3C. Thus, SCR T5 may be triggered either initially in the first quandrant shown in FIG. 3A to provide maximum power supply output voltage, or alternatively to provide a reduced output voltage by firing late in the second quadrant, i.e., at point B, by selection of the waveform VL1 (FIG. 3B) or VL2 (FIG. 3C) to govern the triggering voltage. Selection of either the waveform on line L1; or that on line L2 is accomplished by means of a cross-coupled gating logic consisting of the two NAND gates G2 and G3. It will be appreciated that whenever gate G2 is disabled, as by grounding switch S1A, gate G3 is automatically enabled, because of the cross-coupling. Thus, with switch S1A grounded gate G2 is disabled, gate G3 is enabled, and the voltage waveform on line L2 is passed to the OR gate G4 to be amplified by the transistor pair T1, T2 to drive the pulse transformer 12 and trigger the SCR T5. With switch S1A connected to +5 volts the reverse process occurs, and the waveform on line L1 is supplied through the gates to the SCR T5. Thus SCR T5 is triggered to fire substantially throughout the entire first two quadrants of FIG. 3A, or alternatively late in the second quadrant thereof. To achieve reliable firing early in the first quadrant, it is only necessary that transformer 12 to have adequate low frequency response so that its output does not substantially sag over an interval of several milliseconds.

Synchronous firing of the second SCR T6 either throughout the entire third and fourth quadrant of FIG. 3A, i.e., between points X and Y, or alternatively late in the fourth quadrant, i.e., at point D, is accomplished by identical means. Here the original waveform VL1 line L1 (FIG. 3B) is fed through an inverter I1 to drive an identical logic network, similarly controlled by switch S1A to control the firing of SCR T6. Thus, one achieves a logically controllable low voltage or high voltage output at the terminals L7 and L8 of the controllable power supply 24 according to the logical state of switch S1A.

The inverter 28 is driven by signals produced on control lines L10 and L14 and having a frequency of either 180 Hz. or 225 Hz. to switch the DC voltage provided on lines L7 and L8 through alternate halves of the input winding of transformer 44, using controlled switching of SCR elements T7 and T8. These control signals are in the form of square waves of the appropriate frequency applied to the inputs of pulse transformers 40 and 42, having their outputs connected respectively to the trigger electrodes of the two SCR units T7 and T8. Reverse transient protection is provided by spike suppression networks R7-D3 and R8-D4 connected across each of the SCR's T7 and T8. Transformer 44 supplies output power to drive the motor via main motor line 34, via capacitor C4 to phase line 36, and to the common line 38.

The voltage controlled oscillator 30 contains a fixed frequency oscillator operating at 4.096 megaherz. governed by crystal X connected in the feedback path around inverter I2 and having an associated network R9, R10, C5 and C6. The output waveform is fed to terminal Q1 of a rate multiplier 46. The particular element shown is a fractional divider set to controllably provide a division of 12/16 or 14/16, the particular pin designation shown in parenthesis in this element corresponding to a type 4089 rate multiplier commonly available on the commercial market, and manufactured by National Semiconductor Corporation, among others. Terminal Q3 of the rate multiplier 46 is shown connected to rotor of switch S1B, here shown functionally ganged to switch S1A of the controllable power supply 24, and operable between either a grounded or a high state. In the grounded state the rate multiplier produces the aforementioned 12/16 division, whereas in the high state a division of 14/16 is provided. The frequency-divided waveform produced at the output terminal Q2 of the rate multiplier 46 is fed to the input terminal Q4 of a settable divider 48. The pin designations shown here in parentheses correspond to that of a type 4020 divider manufactured by National Semiconductor Corporation among others. This element is established to provide a division by a factor of 16,384. As may readily be verified, the output at terminal Q5 of this unit will then provide an output frequency of either 180 Hz. or 225 Hz., according to the setting of switch S1B. The output wave train from terminal Q5 of the controllable divider 48 is fed through a driver D and a resistor R11 to the transistor pair T9, T10 and thence via line L10 to trigger SCR T7 via transformer 40. The logical inverse of this train is provided by an inverter I2 driving transistor pairs T11 and T12 to transformer 42, which in turn triggers SCR T8. It will further be noted that frequency selector switch S1B is only functional in nature, and may equally well take the form of a logical control gate in synchronism with switch S1A. The various means whereby switches S1A and S1B may be controlled, either by means of a timer, or alternatively by the variety of other well-known means, will be apparent by those of ordinary skill in the art.

Thus, the above referenced system supplies over prescribed interval of time during the acceleration phase of the motor a high drive voltage at elevated frequency to provide maximum motor windup torque, followed by a reversion to a low power and reduced frequency condition once the motor is up to speed, a necessary feature if excessive motor heating and concomitant possible high voltage flashover is to be avoided.

While the invention has been particularly shown and described with reference to a preferred embodiment thereof, it will be understood by those skilled in the art, that various changes in form and details may be made therein without departing from the spirit and scope of the invention.

I claim:

1. A system operable from an alternating current source including means for providing power at a first or normal running level and at a first operating frequency to a motor for driving a rotatable anode of an X-Ray tube at a given operating speed, control circuitry for controlling the operation of the motor to accelerate the rotation of said anode from a first condition to the operating speed, said control circuitry including means for effecting a boost cycle at a second higher frequency and a relatively higher second power lever to said motor to accelerate said anode without saturating the motor circuitry, means for controlling the duration of said boost cycle, and means for changing the operating mode of said system from said second frequency and power level to said first operating frequency and power level.

2. A system as in claim 1 including timer means for operating said system at said second frequency for a preset time.

3. A system as in claim 1 further including means for sustaining the boost cycle until the running speed of the rotor is substantially attained.

4. A method of accelerating an anode of an X-ray tube having a rotating anode driven by an induction motor wherein the motor is powered to accelerate said anode during a boost cycle from a stopped condition to a running condition at a preset speed consisting of the steps of (a) applying a first high voltage to the motor at a first and high boost operating frequency;

(b) applying a second relatively lower voltage to the motor at a second or relatively lower running frequency; and (c) changing from said first voltage and said first frequency to said second voltage and said second frequency when said motor has reached a selected speed.

5. A method as in claim 4 wherein step (c) consists of changing from said first voltage and first frequency to said second voltage and said second frequency after a selected time.

* * * * *